US005366351A

United States Patent [19]

Nolte

[11] Patent Number: 5,366,351

[45] Date of Patent: Nov. 22, 1994

[54] PUMP WITH FAILURE RESPONSIVE DISCHARGE VALVE

[75] Inventor: Paul A. Nolte, Memphis, Tenn.

[73] Assignee: Ingersoll-Dresser Pump Company, Liberty Corner, N.J.

[21] Appl. No.: 99,671

[22] Filed: Jul. 29, 1993

[51] Int. Cl.[5] ..... F04B 1/12

[52] U.S. Cl. ..... 417/271; 417/360

[58] Field of Search ..... 417/360, 279, 269, 271

[56] References Cited

U.S. PATENT DOCUMENTS

| | | | |
|---|---|---|---|
| 2,978,150 | 4/1961 | Doelcher | 417/360 X |
| 3,000,543 | 9/1961 | Paul | 417/360 X |
| 3,539,272 | 11/1970 | Howard | 417/360 X |
| 4,324,532 | 4/1982 | Knife | 417/360 X |
| 4,557,669 | 12/1985 | Vanderjagt | 417/271 |
| 4,559,136 | 12/1985 | Dockery | 417/360 X |
| 4,570,833 | 2/1986 | Vanderjagt | 222/333 |
| 4,614,201 | 9/1986 | King et al. | 137/68.1 |
| 4,617,975 | 10/1986 | Rabushka et al. | 141/311 R |
| 4,643,216 | 2/1987 | Allread et al. | 137/68.1 |
| 4,646,773 | 3/1987 | Klop et al. | 137/68.1 |
| 4,674,525 | 6/1987 | Richards et al. | 137/68.1 |
| 4,685,592 | 8/1987 | Vanderjagt | 222/148 |
| 4,762,140 | 8/1988 | Davis | 137/71 |
| 4,779,638 | 10/1988 | Nitzberg et al. | 137/68.1 |
| 4,844,408 | 7/1989 | Beaston | 251/149.8 |
| 4,872,471 | 10/1989 | Schneider | 137/68.1 |
| 4,991,821 | 2/1991 | Beaston | 251/149.8 |
| 5,004,013 | 4/1991 | Beaston | 137/614.05 |
| 5,099,870 | 3/1992 | Moore et al. | 137/71 |
| 5,100,302 | 3/1992 | Ceccherini | 417/360 |

*Primary Examiner*—Richard E. Gluck
*Attorney, Agent, or Firm*—Michael H. Minns

[57] ABSTRACT

An automatic shut-off valve for use with a chemical container and installed pump. The shut-off valve closing in response to an accidental dislodging of the pump motor from the pump.

3 Claims, 5 Drawing Sheets

FIG. 6
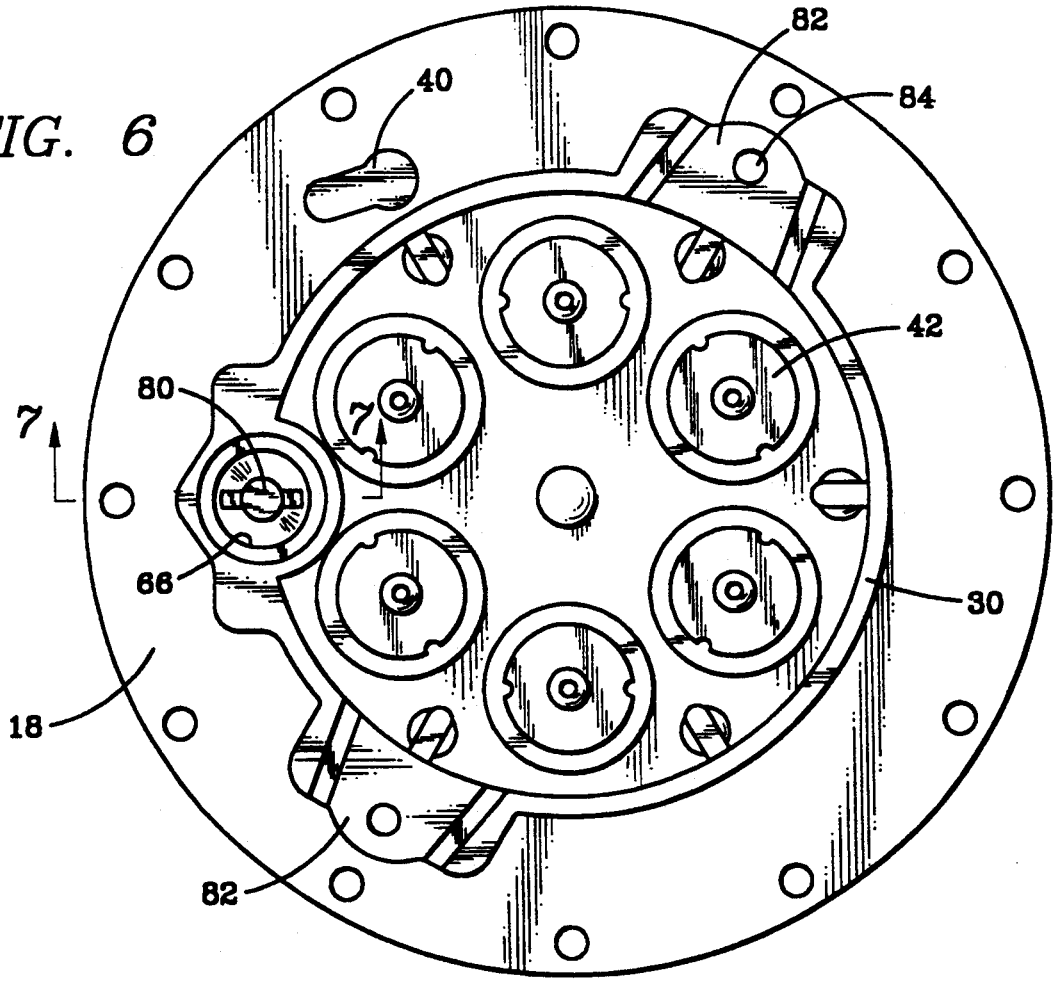
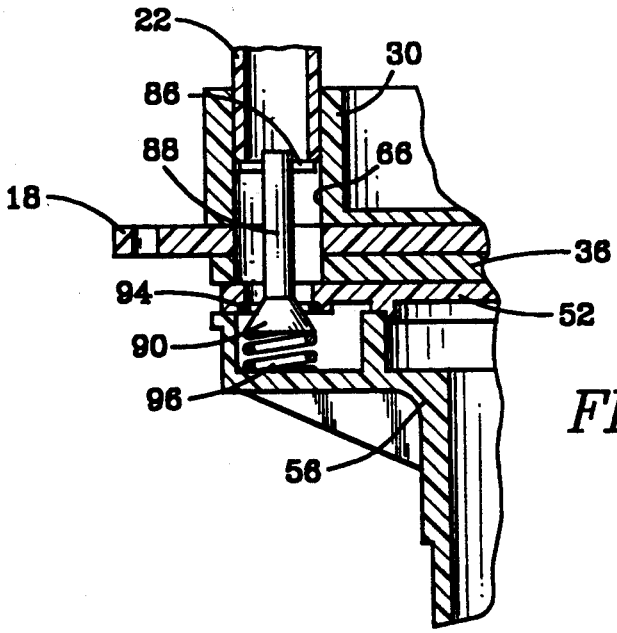
FIG. 7

PUMP WITH FAILURE RESPONSIVE DISCHARGE VALVE

BACKGROUND OF THE INVENTION

This invention relates generally to transfer pumps for agricultural chemicals and more particularly to emergency shut-off valves for use with such pumps.

Equipment used to handle chemicals, such as agricultural pesticides and herbicides, must be designed to prevent leakage in the event of a catastrophic accident. A typical accident involves a chemical container and installed pump falling out of a transport vehicle. Frequently, the pump motor shears off, damaging the pump or container, thereby causing uncontrolled leakage of chemicals.

The foregoing illustrates limitations known to exist in present agricultural chemical transfer pumps. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pump comprising: a pump body having an inlet, an outlet and a pump therein; a motor for operating the pump; attachment means for detachably coupling the motor to the pump body; and valve means for controlling the flow of fluid from the pump body outlet, the valve means opening in response to the motor being attached to the pump body and closing in response to the removal of the motor.

The foregoing and other aspects will become apparent from the following detailed description of the invention when considered in conjunction with the accompanying drawing figures.

BRIEF DESCRIPTION OF THE DRAWING FIGURES

FIG. 6 is a plan view of the pump shown in FIG. 1; and

FIG. 7 is a sectional view taken on line 6—6 of FIG. 6 showing the details of the automatic shut-off valve.

DETAILED DESCRIPTION

Figure 1:
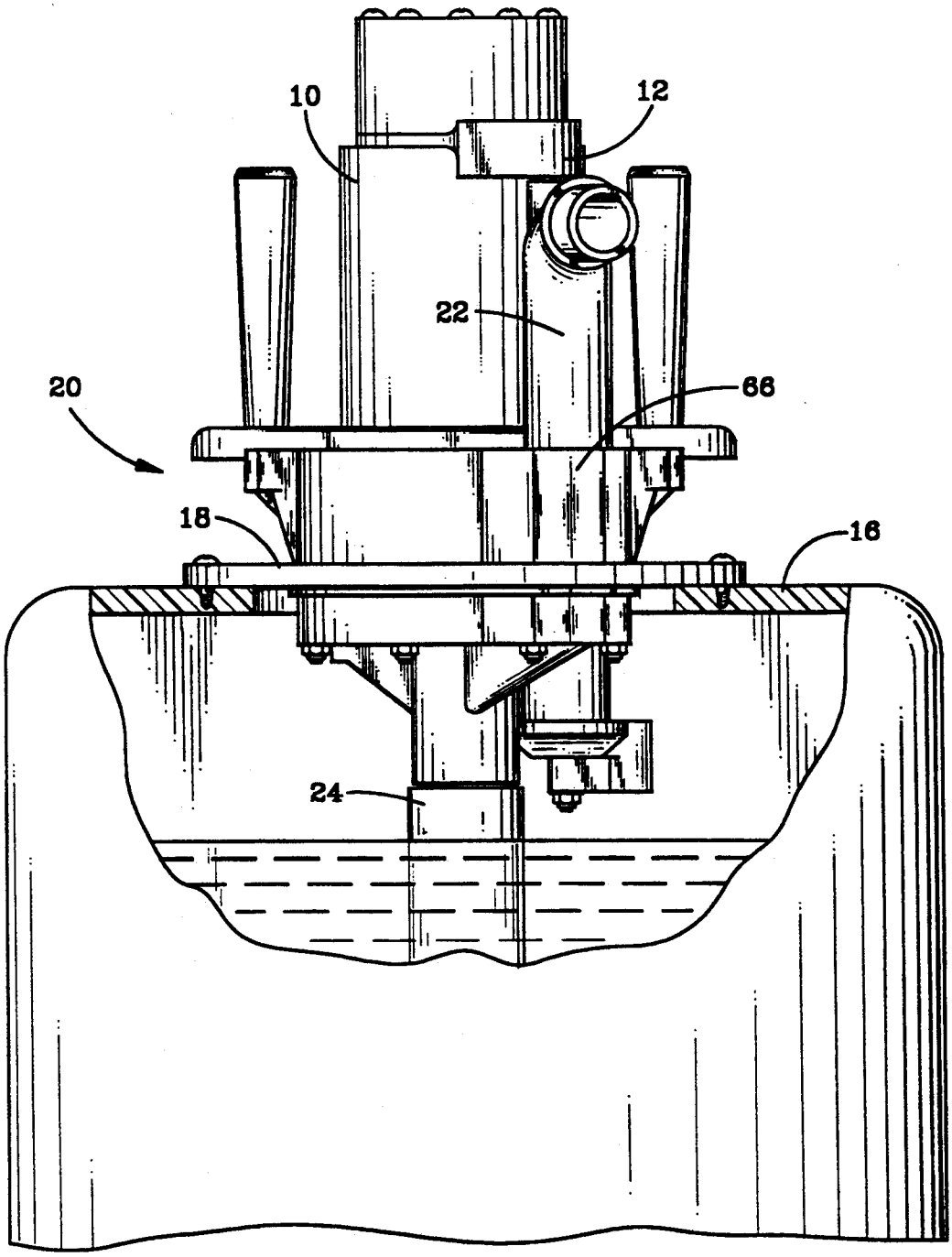
FIG. 1 is a side elevational view of a pumping system incorporating an automatic emergency shut-off valve.

FIG. 1 shows a pumping system, primarily for use with agricultural chemicals. Chemical containers 16, typically molded from plastic, are used to ship and dispense herbicides and pesticides. A large opening, about six inches in diameter, is provided in the top of the container 16 to accommodate a pump 20. The pump 20 shown in the FIGURES uses a detachable motor 10. The motor 10 may be permanently attached to the pump 20. An adapter plate 18 is used to mount the pump 20 to the container 16. A suction tube 24 attached to the pump inlet 60 extends into the container 16. The suction tube 24 has a suction fitting (not shown) which is biased into contact with the container bottom. A discharge elbow 22 is slidingly attached to the pump outlet 66. An elbow support 12 on the motor 10 housing holds the discharge elbow 22 in place when the motor 10 is attached to pump 20.

FIGS. 6 and 7 illustrate one embodiment of an automatic shut-off valve 80 used in the pump outlet 66 to prevent uncontrolled spillage of chemical from the container 16 in the event of a catastrophic accident. Shut-off valve 80 is a spring biased valve which is biased towards a closed position. The valve 80 has an elongated upwardly extending valve stem 88 with a cross arm 86 inserted in a bore in the upper end of the valve stem 88. The lower end of the valve stem 88 is formed into a valve seat 90 which seals against an O-ring 94 at the bottom of the pump outlet 66. A pump bottom housing 56, attached to lower end of the pump 20, provides support for a spring 96 which biases the valve 80 towards a closed position.

Figure 2:
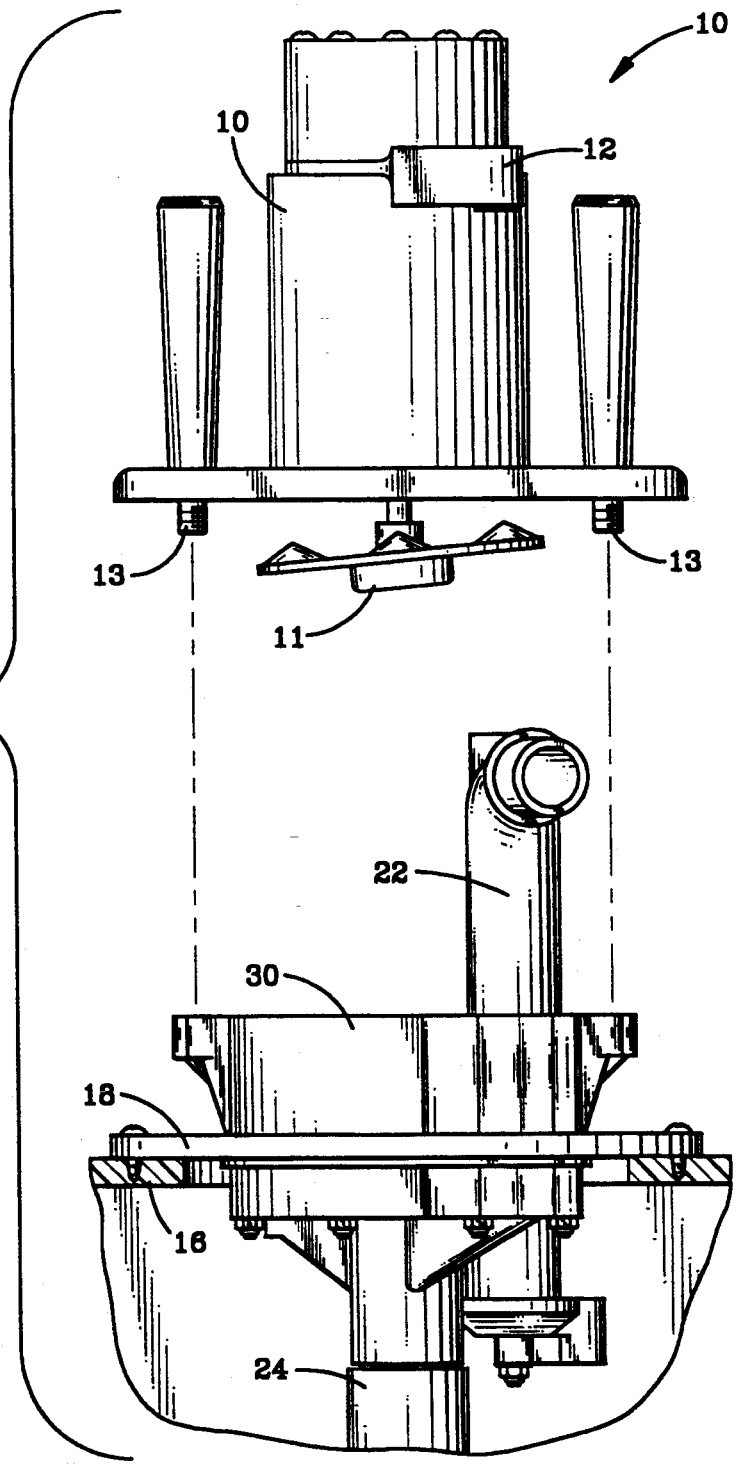
FIG. 2 is an exploded view of the pumping system shown in FIG. 1, illustrating the removable motor.

The preferred embodiment of the pumping system uses a detachable motor 10 as shown in FIGS. 1 and 2. The motor 10 is attached to a pump top housing 30 by a pair of screws 13 which are threaded into threaded inserts 84 located in motor mounting supports 82 radially extending from the pump top housing 30. Prior to attaching the motor 10 to the pump 20, a discharge elbow 22 is inserted into the pump outlet 66. The elbow 22 presses down on the valve cross arm 86, moving the shut-off valve 80 to an open position. An elbow support 12 attached to motor 10 housing holds the elbow 22 in place against the force of the spring 96.

The pump outlet 66 of the pump top housing 30 is weaker than the rest of the pump top housing 30. In the event of a catastrophic accident, such as the chemical container 16, along with pump 20 and attached motor 10, falling out of a transport vehicle, the threaded inserts 84 will slip out of the motor mounting supports 82 and the weaker pump outlet 66 will split. This releases the motor 10 and the elbow 22 from the pump 20. Once the elbow 22 is released from the pump outlet 66, the spring 96 will cause the shut-off valve 80 to close, thereby preventing the uncontrolled release of chemicals from container 16.

The preferred embodiment uses an unthreaded slip fit of the elbow 22 into the pump outlet 66. Since the pump outlet 66 will split in response to a catastrophic accident, the elbow 22 may be threaded into the pump outlet 66.

The valve seat 90 is located below the adapter plate 18. This protects the integrity of the seat in the event of a catastrophic accident. If the valve seat 90 were located in the pump top housing 30, the integrity of the seat might be damaged by the same forces which cause the pump outlet 66 to split.

Figure 3:
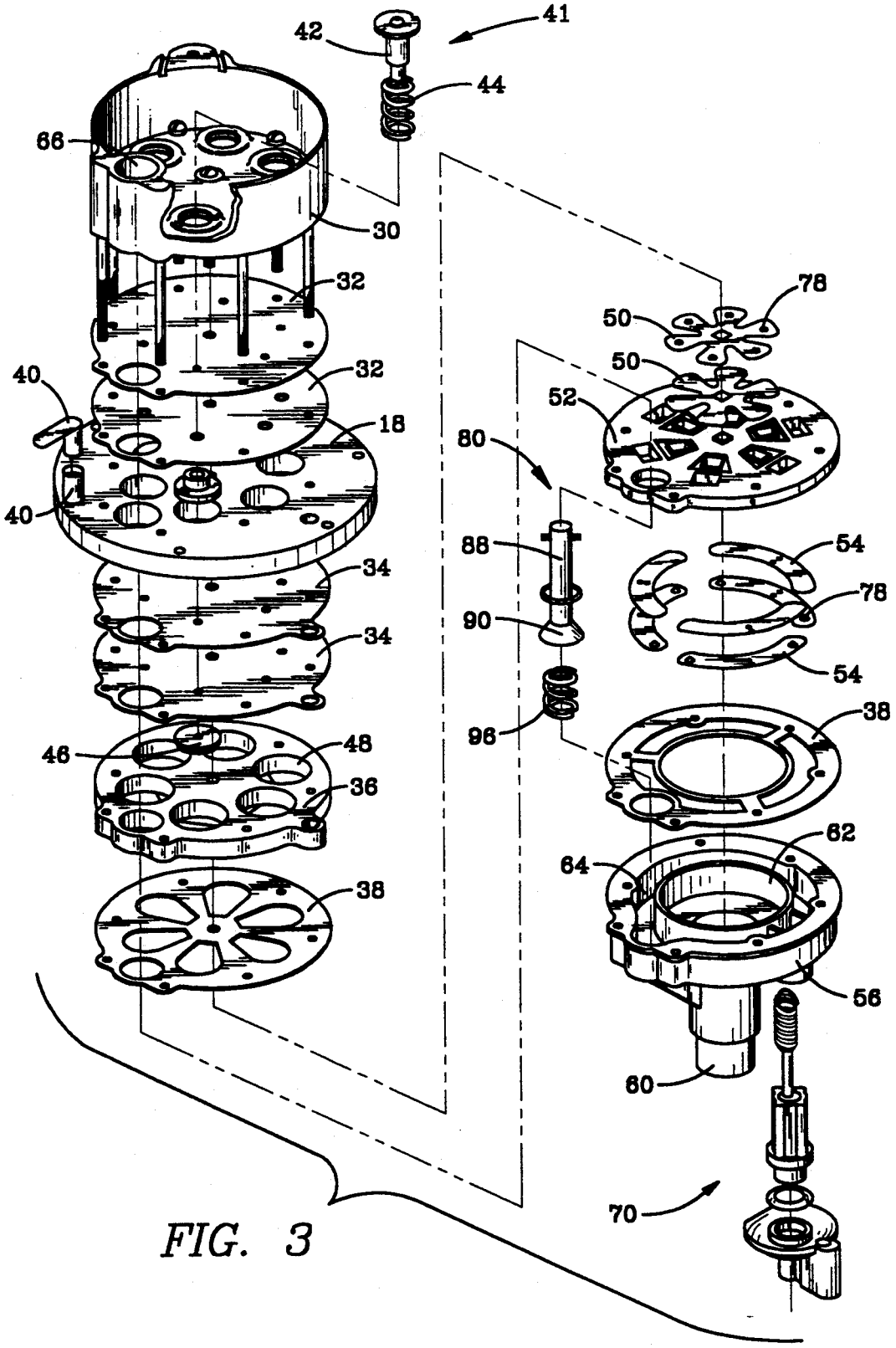
FIG. 3 is an exploded perspective of the pump shown in FIG. 1.
Figure 4:
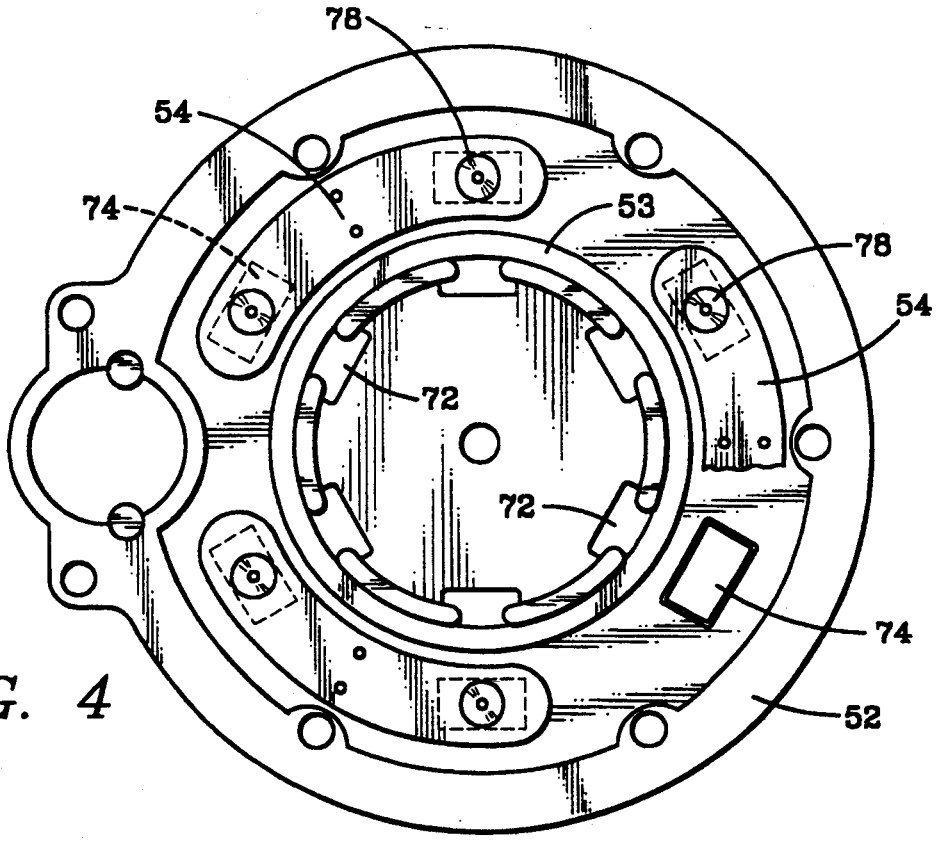
FIG. 4 is a bottom view of the valve plate with the valves in place.
Figure 5:
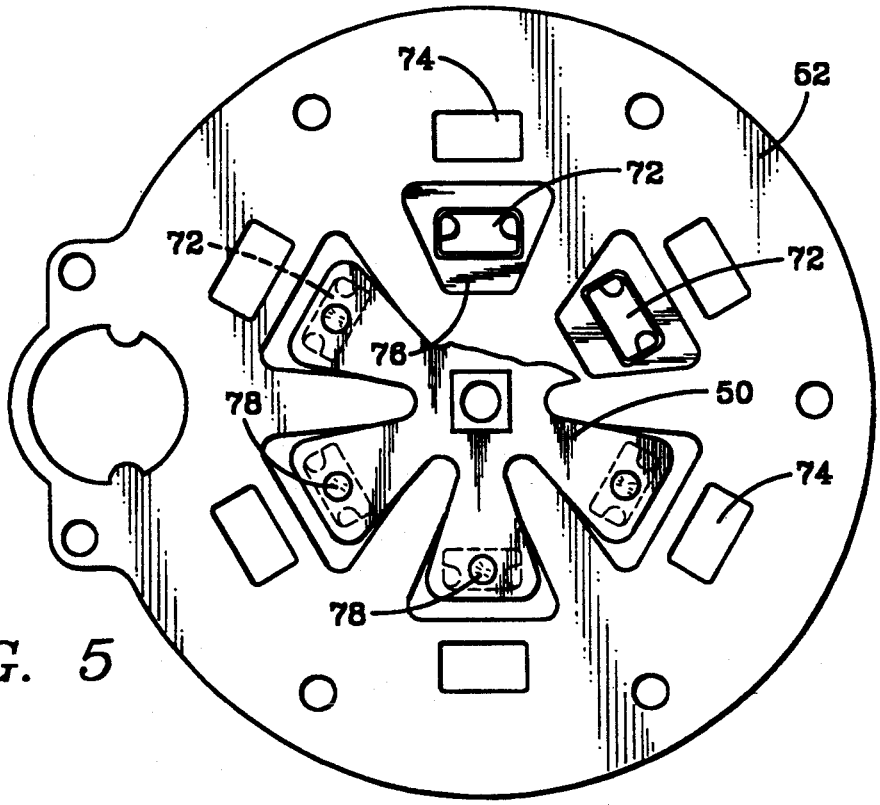
FIG. 5 is a plan view of the valve plate shown in FIG. 4.

The preferred pump 20 is a diaphragm pump with a detachable motor 10 as shown in the FIGURES. The pump 20 uses a pump top housing 30 and a pump lower housing 56. The pump inlet 60 is part of the pump lower housing 56. An adapter plate 18, cylinder plate 36 and valve plate 52 along with several gaskets 32, 38 are sandwiched between the pump top housing 30 and the pump lower housing 56. A flexible diaphragm 34 is sandwiched between the adapter plate 18 and the cylinder plate 36. A pair of diaphragms 34, a primary and a backup, are provided. The pump housings, gaskets, diaphragms and plates are held together by bolts as shown in FIG. 3. The pump top housing 30, the pump lower housing 56 and the various components sandwiched between the housings define a pump body.

The pump lower housing 56 includes inlet chamber 62 in fluid communication with the pump inlet 60 and a plurality of inlet apertures 72 in the valve plate 52. A concentric outlet chamber 64 is positioned radially outward of the inlet chamber 62. The outlet chamber 64 is in fluid communication with the pump outlet 66 and a plurality of outlet apertures 74 in the valve plate 52. A bypass valve 70 is also provided in the outlet chamber 64. This is a spring operated valve which opens to relieve excess discharge from the pump 20 back into the container 16. The bypass valve 70 may be provided with a manual operator (not shown) which allows the bypass valve 70 to be manually opened to recirculate the fluid in the container 16. The manual recirculation mixes any separated chemicals.

A plurality of pistons 41 are attached to the diaphragms 34. Each piston 41 is comprised of piston top 42 with a piston spring 44 located above the diaphragms 34 within the pump top housing 30 and a piston cap 46 located below the diaphragms 34 within a plurality of cylindrical openings 48 in the cylinder plate 36. The cylindrical openings 48 in combination with the pistons 41 define pumping chambers. The piston springs 44 bias the pistons to an upper position.

The valve plate 52 includes a plurality of inlet apertures 72 and a plurality of outlet apertures 74. The inlet apertures 72 and outlet apertures 74 are separated by a downward extending circular partition 53 on the underside of the valve plate 52. A plurality of spring actuated outlet valve assemblies 54 operate respectively with outlet apertures 74. Each outlet valve assembly 54 is preferably a pair of leaf springs, each leaf spring having an arcuate flat shape and being formed of resilient spring steel. The leaf spring adjacent the valve plate is thinner than the outer leaf spring. A dimple 78 is provided at the outer ends of the outer leaf spring. The dimple 78 is centered over the outlet apertures 74. This concentrates the spring force of the outer leaf spring on the valve seat and improves sealing of the outlet valve assemblies 54 to the outlet apertures 74. An inlet valve assembly 50 operates respectively in conjunction with the inlet apertures 72. The inlet valve assembly 50 is preferably a pair of leaf springs having a plurality of radially extending fingers. As described for the outlet valve assembly 54, the inlet valve assembly 50 leaf spring adjacent the valve plate 52 is thinner than the outer leaf spring. Dimples 78 are also provided to concentrate the spring force of the outer leaf spring over the inlet apertures 72. There is a recess 76 provided in the upper surface of the valve plate 52 beneath each extending finger of the inlet valve assembly 50. The recesses 76 reduce the buildup of chemicals beneath the extending fingers which might otherwise occur and prevent the seating of the inlet valve assembly over the inlet apertures 72.

The motor 10 is preferably a twelve volt DC motor. A wobble or swash plate 11 is attached to the motor shaft. The swash plate 11 is tilted relative to the axis of the motor shaft. As the motor 10 rotates, the swash plate 11 operates the pistons 41 sequentially, which in turn causes chemical to be pumped into and through each pumping chamber 48.

An operable vent 40 is provided in the adapter plate 18. The vent 40 is opened prior to operating the pump 20. This allows air to be drawn into the container 16 while chemical is being pumped out.

The diaphragm pump described above is similar to the diaphragm pumps described in U.S. Pat. Nos. 4,557,669, 4,570,833 and 4,685,592, all by J. Vanderjagt, the specifications and drawings of which are hereby incorporated by reference. In particular, the description and operation of the bypass valve is described in detail in U.S. Pat. No. 4,685,592.

The preferred embodiment utilizes a diaphragm pump 20, as shown in the FIGURES. Other pumps, such as gear pumps and piston pumps may also be used. Six pistons are provided in the diaphragm pump to increase capacity and to increase reliability. In the event that one or more pistons fail to function, the remaining pistons should provide sufficient capacity for the pump to be used without requiring repairs. The diaphragm pump 20 has a one inch unthreaded straight hole for a discharge port 66. The pump top housing 30 and discharge port 66 are formed from 40% glass filled polypropylene. An aluminum elbow 22 is inserted and held in place by the removable drive motor 10 during pumping. A spring loaded automatic shut-off valve 80 is located in the discharge port 66.

Unless the aluminum elbow 22 is in place, the shut-off valve 80 remains in a closed position and will not let chemical fluids out. When the aluminum elbow 22 is inserted into the discharge port 66, the shut-off valve 80 is opened to allow the flow of chemical through the elbow 22. The shut-off valve 80 is designed into the body of the pump 20 so that during an accident, in which the aluminum elbow 22 is torn from the pump 20, the shut-off valve 66 remains intact and closes, thereby not allowing flow of chemical from the container 16.

Having described the invention, what is claimed is:

1. A pump comprising:

a pump body having an inlet, an outlet and a pump therein;

a motor for operating the pump;

attachment means for detachably coupling the motor to the pump body;

valve means for controlling the flow of fluid from the pump body outlet, the valve means opening in response to the motor being attached to the pump body and closing in response to the removal of the motor, the valve means comprising a valve within the pump body outlet and a biasing means for biasing the valve towards a closed position; and a discharge pipe attached to the pump body outlet, the biasing means tending to expel the discharge pipe from the pump body outlet, the discharge pipe being restrained by the attached motor.

2. A pump comprising:

a pump body having an inlet, an outlet and a pump therein;

a motor for operating the pump;

attachment means for detachably coupling the motor to the pump body; and valve means for controlling the flow of fluid from the pump body outlet, the valve means opening in response to the motor being attached to the pump body and closing in response to the removal of the motor;

the pump body having a plurality of regions including a first region which forms the pump body outlet, the first region having a strength less than the other regions, whereby in response to an uncontrolled dislodging of the attached motor, the pump body outlet splits and the rest of the pump body remaining intact.

3. A pumping apparatus for heavy viscous chemicals and the like comprising:

a pump body, the pump body having an inlet chamber, an outlet chamber separated from the inlet chamber and an outlet in fluid communication with the outlet chamber;

a diaphragm in the pump body, the diaphragm having a first side and a second side;

a valve plate in the pump body, the valve plate having a plurality of inlet apertures and a plurality of outlet apertures;

a pumping chamber plate in the pump body establishing with the valve plate a plurality of pumping chambers respectively communicating with the inlet apertures and the outlet apertures;

a plurality of spring actuated inlet valves operating respectively in conjunction with the inlet apertures for the opening and closing thereof to govern flow from the inlet chamber to the pump chambers;

a plurality of spring actuated outlet valves operating in conjunction with the outlet apertures for the opening and closing thereof to govern flow from the pump chambers to the outlet chamber;

a plurality of pistons attached to the diaphragm and operable respectively relative to the pump chambers moveable between a raised position and a lowered position in the pump chambers, each of the pistons including a spring associated therewith for moving the piston to the raised position;

a motor including a rotatable shaft;

a non-rotatable swash plate attached to the motor shaft and engaging the pistons for successively moving the pistons into the lowered position and for subsequently allowing the pistons to successively move into the raised position;

attachment means for detachably coupling the motor and swash plate to the pump body on the first side of the diaphragm, the attachment means allowing the motor and swash plate to be quickly attached to or removed from the pump without requiring any mechanical connection or disconnection between the swash plate and the pistons;

an elbow attached to the pump body outlet;

a control valve for controlling the flow of fluid from the pump body outlet, the control valve opening in response to the motor and swash plate being attached to the pump body and automatically closing in response to removal of the motor and swash plate; and a biasing means for biasing the control valve towards the closed position, the biasing means tending to expel the elbow from the pump body outlet, the elbow being restrained by the attached motor.

* * * * *